US006691880B2

(12) United States Patent
Kostant

(10) Patent No.: US 6,691,880 B2
(45) Date of Patent: Feb. 17, 2004

(54) PICK DECK

(75) Inventor: Anthony N. Kostant, Winnetka, IL (US)

(73) Assignee: Konstant Products, Inc., Skokie, IL (US)

( * ) Notice: Subject to any disclaimer, the term of this patent is extended or adjusted under 35 U.S.C. 154(b) by 61 days.

(21) Appl. No.: 10/104,803

(22) Filed: Mar. 22, 2002

(65) Prior Publication Data

US 2003/0010740 A1 Jan. 16, 2003

Related U.S. Application Data

(63) Continuation-in-part of application No. 09/904,299, filed on Jul. 12, 2001, now Pat. No. 6,497,332.

(51) Int. Cl.[7] ..... A47B 47/00
(52) U.S. Cl. ..... 211/189
(58) Field of Search ..... 211/189, 186, 211/191, 195; 99/449

(56) References Cited

U.S. PATENT DOCUMENTS

| | | | | | |
|---|---|---|---|---|---|
| 471,697 | A | * | 3/1892 | Mosbacher | 108/188 |
| 1,655,593 | A | * | 1/1928 | Bulman | 211/195 |
| 2,925,921 | A | * | 2/1960 | De Pew et al. | 211/189 |
| 4,078,664 | A | * | 3/1978 | McConnell | 211/189 |
| 4,349,213 | A | * | 9/1982 | Hirsch | 280/638 |
| 4,946,050 | A | * | 8/1990 | Akopiantz | 211/182 |
| 5,181,815 | A | * | 1/1993 | Haberkorn | 410/140 |
| 5,269,112 | A | * | 12/1993 | Weinrub et al. | 52/646 |
| 5,279,431 | A | * | 1/1994 | Highsmith et al. | 211/189 |
| 6,422,407 | B2 | * | 7/2002 | Arai | 211/189 |

OTHER PUBLICATIONS

Frazier "Glide 'n Pick" brochure (2000).

* cited by examiner

*Primary Examiner*—Alvin Chin-Shue
*Assistant Examiner*—Sarah Purol
(74) *Attorney, Agent, or Firm*—Niro, Scavone, Haller & Niro

(57) ABSTRACT

An improved storage rack system having a pick deck that allows for easy access to loads on pallets by order pickers.

8 Claims, 3 Drawing Sheets

PICK DECK

This application is a continuation-in-part of co-pending application Ser. No. 09/904,299, filed on Jul. 12, 2001. Now U.S. Pat. No. 6,497,332

BACKGROUND OF THE INVENTION

The present invention relates generally to improved storage racks and, in particular, to storage racks having an improved pick deck for allowing easy access to loads stored on pallets by warehouse personnel.

Well known, shelf-type storage racks typically include at least four columns rigidly connected by cross beams positioned in transverse relation to the columns forming what are commonly known as storage rack trusses. The racks may be arranged as a pair of back-to-back arrays with each array facing an access aisle. Typically, racks have pick decks located adjacent to the access aisle where pallets, their loads and/or portions of their loads may be accessed by warehouse personnel who are typically referred to as order pickers.

In the grocery sector, for example, loads of products are shipped from the manufacturer to a wholesaler on pallets, which are often stored by the wholesaler on shelf-type storage racks. Order pickers at the wholesaler then typically unload (or pick) only portions of a load for ultimate shipment to a retail store. The columns of standard rack storage systems are typically spaced 96 inches apart and 44 inches deep. Standard pallets are typically 40 inches wide by 48 inches deep. Thus, in many instances, two pallets are stored side-by-side on the rack, the loads of which are accessible by an order picker from the access aisle.

However, because of the configuration of the standard and known pick decks of standard rack systems, access to the load on the pallet can be difficult and cumbersome.

SUMMARY OF THE INVENTION

The present invention preserves the advantages of the various known rack storage systems and also provides new features and advantages. For example, the present invention provides a rack storage system having a pick deck that allows easy access by order pickers to the products stored on pallets.

In the preferred embodiment of the present invention, diagonal pallet support beams span diagonally between front and rear columns of adjacent storage rack trusses. One diagonal beam spans from the front column of one truss to the rear column of the adjacent truss. A second diagonal beam consists of two beam sections spanning from the other front and rear columns to the center of the first diagonal beam. At the rear of the pick deck, a safety beam spans the diagonal pallet support beams at or almost at deck depth. In this manner, two pallets may be placed laterally on the pick deck against the rack trusses leaving approximately 16 inches between the two pallets. The diagonal pallet support beam arrangement allows order pickers to step between the side-by-side pallets (up to almost half of their depth), which makes it easier to reach the goods on the pallets and particularly the rear of the pallet. The rear support beam eliminates the possibility of the pallets tipping as they are unloaded.

In another preferred embodiment of the present invention, the safety beam spans between the two rear parallel columns. And, in yet another embodiment, the second diagonal beam may be one piece.

Accordingly, an object of the present invention is to provide an improved pick deck for rack storage systems that permit easy access to loads stored on pallets by order pickers.

Another object of the present invention is to provide a safety beam that prevents pallets from tipping over as they are unloaded.

Yet another object of the present invention is to provide an improved pick deck for rack storage systems that is useful in a variety of storage applications, including, but not limited to, the grocery sector.

A further object of the present invention is to provide an improved pick deck that can be retrofitted into existing rack storage systems or installed into new storage rack systems.

Still a further object of the present invention is to provide an improved pick deck for rack storage structures that saves costs from other pick decks.

An additional object of the present invention is to eliminate the necessity of having to rotate a pallet to get at the rear cases on the pallet.

INVENTOR'S DEFINITION OF THE TERMS

The terms used in the claims of this patent are intended to have their broadest meaning consistent with the requirements of law. Where alternative meanings are possible, the broadest meaning is intended. All words used in the claims are intended to be used in the normal, customary usage of grammar and the English language.

BRIEF DESCRIPTION OF THE DRAWINGS

The stated and unstated features and advantages of the present invention will become apparent from the following descriptions and drawings wherein like reference numerals represent like elements in the various views, and in which.

DETAILED DESCRIPTION OF PREFERRED EMBODIMENTS

Set forth below is a description of what is currently believed to be the preferred embodiment or best representative example of the inventions claimed. Future and present alternatives and modifications to the preferred embodiment are contemplated. Any alternatives or modifications which make insubstantial changes in function, purpose, structure or result are intended to be covered by the claims of this patent.

Figure 1:
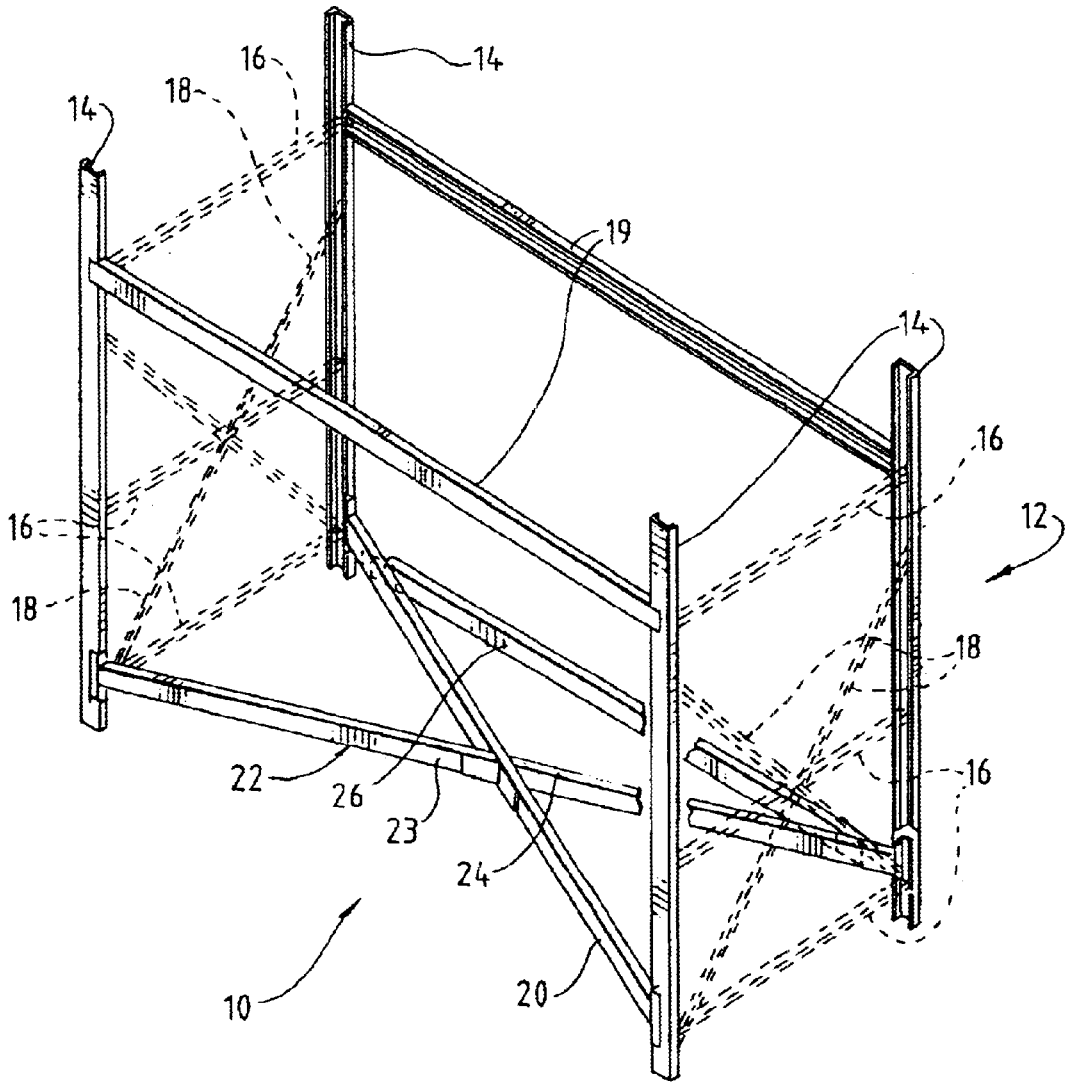
FIG. 1 is a side perspective view of a typical storage rack truss system, including a preferred embodiment of a pick deck of the present invention.
Figure 2:
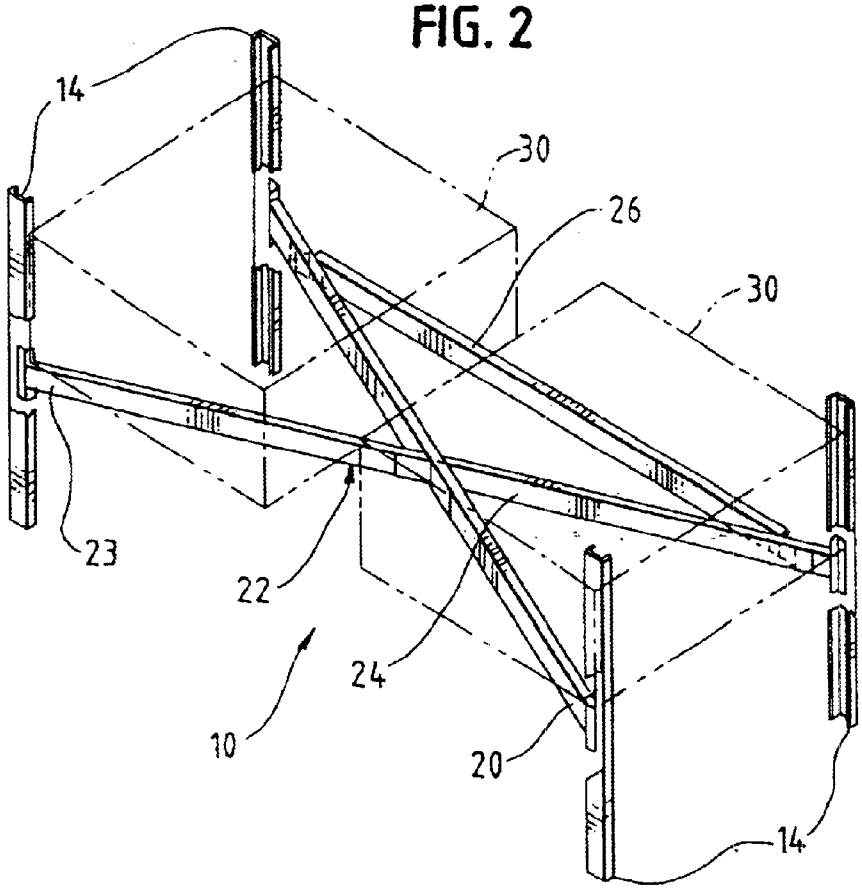
FIG. 2 is a side perspective view of a preferred embodiment of the present invention of FIG. 1 with portions of the storage rack truss system removed for clarity, and including two representative pallets and loads shown in phantom view.
Figure 3:
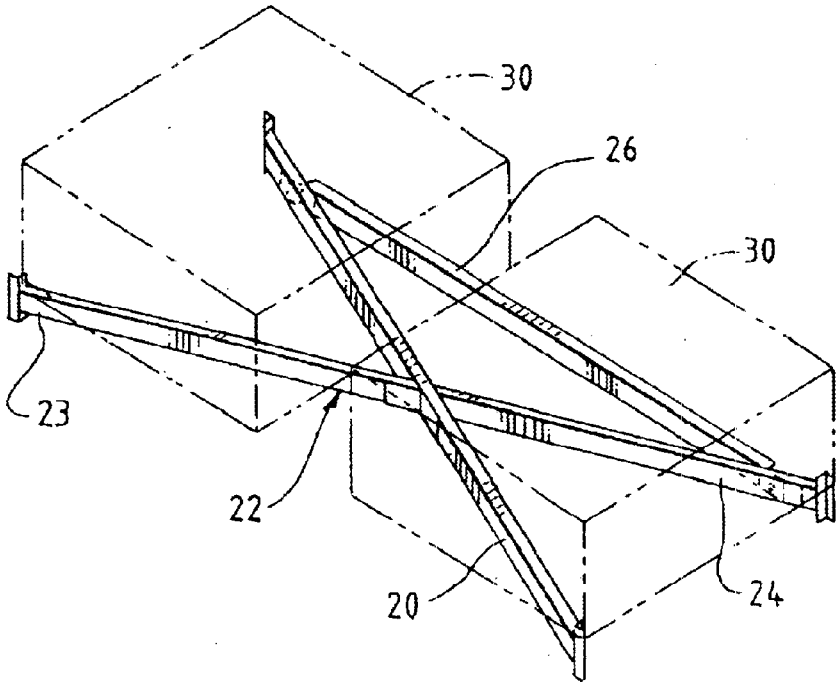
FIG. 3 is a side perspective view of the preferred embodiment of the present invention of FIG. 2 with all of the storage rack truss system removed for clarity, and including two representative pallets and loads shown in phantom view.

An improved pick deck for a rack storage system is shown generally as 10 in FIGS. 1–3. By reference to FIG. 1, a storage rack truss system 12 includes a number of spaced, parallel columns 14, transverse beams 16 interconnecting the columns as well as support braces 18. These components form the standard storage rack trusses 12. Lateral support beams 19 may also be provided.

In the preferred embodiment of the present invention, pick deck 10 consists of diagonal pallet support beam 20 that spans from a front (for example, right) column 14 of rack system 12 to the rear (for example, left) column 14 of the adjacent rack system truss 12. Another diagonal support beam 22 consists of one section 23 spanning from the other front (for example, left) column to the center of diagonal pallet support beam 20 and a second section 24 spanning from the center of diagonal support beam 20 to the other rear (for example, right) column 14. It will be understood that any arrangement of a wide variety of structural components may be welded or otherwise constructed to form the diagonal support beams 20, 22 of the present invention. Diagonal pallet support beams 20 and 22 form the principal pallet supports of pick deck 10.

Figure 5:
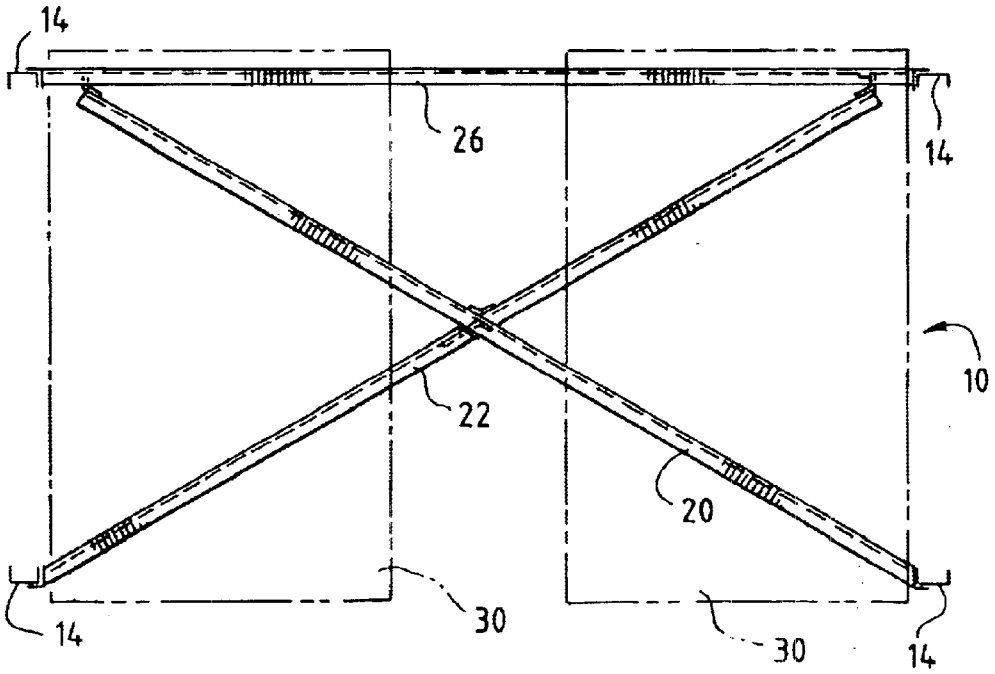

Alternatively, diagonal support beam 20 may be slotted or have or hole so that the other diagonal support beam 22 does not have to consist of two separate sections (see FIG. 5). It will be understood by those of ordinary skill in the art that other arrangements are available as well, such as a notch to accommodate diagonal support beam 20, consistent with the spirit of the present invention.

In the preferred embodiment of the present invention, a safety beam 26 may also be provided. Safety beam 26 spans the rear of diagonal support beams 20 and 22 at almost the depth of pick deck 10. In an alternative preferred embodiment of the present invention, safety beam 26 may span between and be connected to the pair of adjacent rear columns 14 (see FIG. 5). This embodiment may be used with a single or two-piece diagonal beam. This embodiment may, among other things, save costs because a standard front or rear structural beam may be used as safety beam 26. The function and operation of the present invention 10, including safety beam 26, will be hereinafter described.

It will also be understood by those of ordinary skill in the art that diagonal pallet support beams 20 and 22 (including both sections 23 and 24 of diagonal support beam 22) may be attached to rack structure 12 by a variety of well known means, such as bolts, welding and the like. In addition, although channel structural members are shown and used for many of the components in the preferred embodiment of the support structure 12 and other assemblies, it will be understood that a wide variety of cross-sectional shapes (including rectangular, square, round tube and hot-rolled I and S beam cross-sections) may also be used for the support structure and other components and assemblies of the present invention.

The features, advantages and operation of the present invention may best be seen by reference to FIGS. 2–3 and 5. Two representative pallets and their loads 30 (as shown in phantom line) are placed upon pick deck 10. As previously indicated, the columns 14 of a standard rack storage system are typically spaced 96 inches apart. Standard pallets 30 are typically 40 inches wide by 48 inches deep. Thus, when pallets 30 are placed as far apart laterally as possible on pick deck 10, there remains approximately 16 inches of space between the pallets 30. This space, in conjunction with the novel pick deck 10 arrangement with diagonal support beams 20 and 22 of the present invention, enables an order picker to step between the side-by-side pallets to almost one-half of their depth. This makes it much easier to reach the loads on the rear of the pallet. In addition, as portions of the load are being removed from a pallet, an order picker will usually start at the front of the pallet. As a result, the rear of the pallet may become heavier than the front. Tip over is prevented by safety beam 26.

Figure 4:
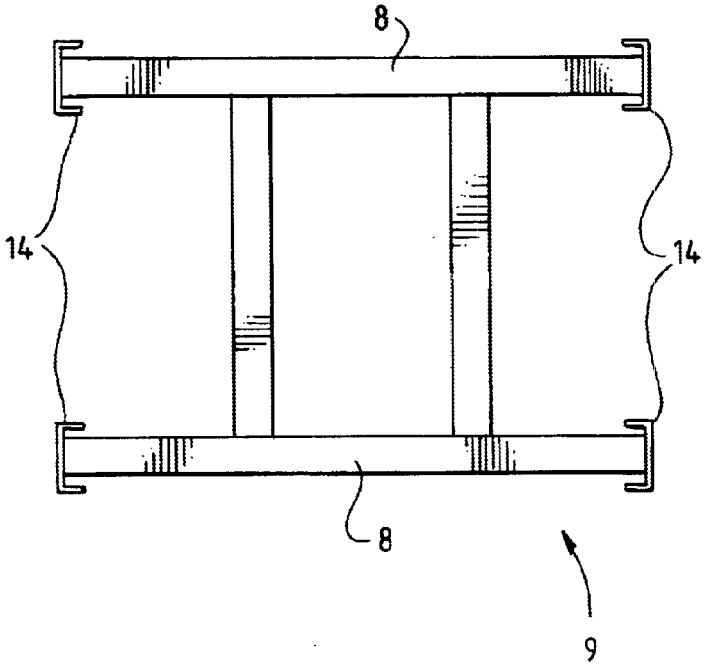
FIG. 4 is a top schematic view of the beam arrangement of a typical prior art pick deck; and, FIG. 5 is a top plan view of an alternate preferred embodiment of the present invention showing the rear support or safety beam spanning between the pair of adjacent rear columns of a typical storage rack truss, and a two-piece second diagonal beam.

Finally, the prior art pick deck 9 is shown in FIG. 4. Because the prior art pick deck 9 consists of two lateral support beams 8 and two or more transverse cross beams 7, it is not possible to step between the pallets to reach the loads.

The above description is not intended to limit the meaning of the words used in the following claims that define the invention. Rather, it is contemplated that future modifications in structure, function or result will exist that are not substantial changes and that all such insubstantial changes in what is claimed are intended to be covered by the claims. Thus, while preferred embodiments of the present inventions have been illustrated and described, it will be understood that changes and modifications can be made without departing from the claimed invention.

Various features of the present inventions are set forth in the following claims.

What is claimed is:

1. A rack storage system including an improved pick deck comprising:

at least one right front column;

at least one left front column parallel to said right front column;

at least one right rear column;

at least one left rear column parallel to said left front column;

at least one diagonal pallet support beam spanning between one right front column and one left rear column having a slot; and, at least one diagonal pallet support beam spanning between the left front column and the right rear column through the slot in the diagonal support beam.

2. The invention of claim 1 wherein a safety beam is provided which spans between the rear right and rear left columns.

3. The invention of claim 1 wherein a safety beam is provided which spans between the rearward portion of the diagonal pallet support beams.

4. An improved pick deck for a rack-type storage system, said system including at least two spaced parallel front columns and at least two spaced parallel rear columns, said pick deck comprising:

at least one pallet support beam spanning diagonally between one front column and the opposite rear column;

at least one two-piece pallet support beam, one piece spanning between the other front column to the pallet support beam and one section spanning between the other rear column and the pallet support beam; and, a safety beam spanning between the rear of the at least two spaced parallel rear columns.

5. The invention of claim 4 wherein said two-piece pallet support beam is only one piece.

6. The invention of claim 5 wherein said safety beam spans between the rearward portion of said support beams.

7. An improved pick deck for a rack-type storage system, said system including at least two spaced parallel front columns and at least two spaced parallel rear columns, said pick deck comprising:

at least one pallet support beam spanning diagonally between one front column and the opposite rear column;

at least one two-piece pallet support beam, one piece spanning between the other front column to the pallet support beam and one section spanning between the other rear column and the pallet support beam; and, a safety beam spanning between the said at least two spaced parallel rear columns.

8. The invention of claim 7 wherein said at least one two-piece pallet support beam is only one piece.

* * * * *